US007144227B2

(12) United States Patent
Cäsar et al.

(10) Patent No.: US 7,144,227 B2
(45) Date of Patent: Dec. 5, 2006

(54) RECIPROCATING-PISTON MACHINE WITH A DRIVER

(75) Inventors: Roland Cäsar, Stuttgart (DE); Peter Kuhn, Weinheim (DE)

(73) Assignees: DaimlerChrysler AG, Stuttgart (DE); Obrist Engineering GmbH, Lustenau (AU)

( * ) Notice: Subject to any disclaimer, the term of this patent is extended or adjusted under 35 U.S.C. 154(b) by 586 days.

(21) Appl. No.: 10/713,781

(22) Filed: Nov. 14, 2003

(65) Prior Publication Data

US 2004/0134342 A1 Jul. 15, 2004

Related U.S. Application Data

(63) Continuation-in-part of application No. PCT/EP02/02829, filed on Mar. 14, 2002.

(30) Foreign Application Priority Data

May 16, 2001 (DE) ..... 101 24 031

(51) Int. Cl.
*F04B 1/12* (2006.01)

(52) U.S. Cl. ..... 417/269; 417/222.1; 417/222.2

(58) Field of Classification Search ..... 417/222.1, 417/222.2, 269; 92/12.2, 13
See application file for complete search history.

(56) References Cited

U.S. PATENT DOCUMENTS 4,061,443 A 12/1977 Black et al.
5,931,079 A 8/1999 Kazahaya
6,164,251 A 12/2000 Nishimura et al.
6,164,252 A * 12/2000 Kuhn et al. ..... 123/56.3
6,928,919 B1 * 8/2005 Parsch ..... 92/12.2
6,968,751 B1 * 11/2005 Shulenberger et al. ..... 74/60
2004/0134342 A1 * 7/2004 Casar et al. ..... 91/499

FOREIGN PATENT DOCUMENTS

| | | |
|---|---|---|
| DE | 198 07 947 | 11/1998 |
| DE | 197 49 727 | 6/1999 |
| DE | 199 12 006 | 9/1999 |
| EP | 0 867 6317 | 9/1998 |
| FR | 2 782 126 | 2/2000 |

* cited by examiner

*Primary Examiner*—Anthony Stashick
*Assistant Examiner*—Vikansha Dwivedi
(74) *Attorney, Agent, or Firm*—Klaus J. Bach

(57) ABSTRACT

In a reciprocating-piston machine, in particular a refrigerant compressor for a motor vehicle air-conditioning system, comprising a machine shaft rotatably supported in a housing with a plurality of pistons arranged circularly around the machine shaft and an annular pivoting disc extending around, and being driven by, the machine shaft, wherein the annular pivoting disc engages the pistons via a joint arrangement disposed on a driver extending from the shaft for transmitting shaft drive forces to the pistons, the annular pivoting disc being supported by a sliding body mounted on a shaft and being pivotable about a hinge axis oriented transversely to the machine shaft, the joint arrangement of the driver is located outside a main center-plane, which extends perpendicularly to the hinge axis and through the axis of rotation of the machine shaft.

9 Claims, 5 Drawing Sheets

RECIPROCATING-PISTON MACHINE WITH A DRIVER

This is a Continuation-In-Part application of international application PCT/EP02/02829 filed Mar. 14, 2002 and claiming the priority of German application DE 101 24 031.7 filed May 16, 2001.

BACKGROUND OF THE INVENTION

The invention relates to a reciprocating-piston machine, particularly a refrigerant compressor for an air conditioning system of a motor vehicle.

DE 197 49 727 A1 discloses a reciprocating-piston machine of the type which comprises a machine housing, in which a plurality of pistons are disposed in a circular arrangement around a rotating drive shaft. The drive force is transmitted from the drive shaft via a driver to an annular pivoting disc and from the latter to the pistons, which are supported so as to be movable parallel to the machine shaft. The annular pivoting disc is mounted pivotably on a sleeve supported on the drive shaft so as to be linearly movable on the drive shaft. The driver is a pin rotationally symmetrical with respect to its major axis and having a spherical head, a slender neck portion and a cylindrical fastening portion. It projects from the machine drive shaft exactly transversely to the pivot axis of the pivoting disc and engages a radially oriented cylindrical bore of the pivoting disc. The torque that can be transmitted from the machine shaft to the pistons is limited, in particular, by the stability of the driver.

It is the object of the invention to provide a reciprocating-piston machine, which transmits a higher torque and a high power for an improved operating performance.

SUMMARY OF THE INVENTION

In a reciprocating-piston machine, in particular a refrigerant compressor for a motor vehicle air-conditioning system, comprising a machine shaft rotatably supported in a housing with a plurality of pistons arranged circularly around the machine shaft and an annular pivoting disc extending around, and being driven by, the machine shaft, wherein the annular pivoting disc engages the pistons via a joint arrangement disposed on a driver extending from the shaft for transmitting shaft drive forces to the pistons, the annular pivoting disc being supported by a sliding body mounted on a shaft and being pivotable about a hinge axis oriented transversely to the machine shaft, the joint arrangement of the driver is located outside a main center-plane, which extends perpendicularly to the hinge axis and through the axis of rotation of the machine shaft.

The main center-plane extends between the pressure side and the suction side of the reciprocating-piston machine. The pistons on the pressure side are in a compression phase, while the pistons on the suction side are in a suction phase. To reduce torque loads on the pivoting disc during the compression movement of the pistons, it is particularly advantageous to arrange the center of the articulation portion of the driver outside the main mid-plane on the pressure side of the reciprocating-piston machine since this is where the largest forces act on the pivoting disc. It is particularly advantageous to arrange the articulation portion of the driver in such a way that the torques on the pivoting disc (in particular, on its hinge axis) are minimal during operation. It is advantageous to arrange the center of the articulation portion approximately in such a way that its perpendicular projection onto the main center-plane is at a point, where the distance of the center of the articulation portion from the axis of rotation of the machine shaft corresponds to the distances of the piston axes from the axis of rotation of the machine shaft.

In a refinement of the invention, the center of the articulation portion is located, at least approximately, on a cylinder envelope defined by the piston axes. The center of the articulation portion consequently rotates approximately along the cylinder envelope and thus in each case intersects the extension line of each piston axis in the compression stroke of the piston. This results in a favorable mass distribution within the reciprocating-piston machine.

Preferably, the contact point between the articulation portion and the pivoting disc is located on the cylinder envelope, which contains the piston axes. The contact point between the articulation portion and the pivoting disc therefore rotates exactly on the cylinder envelope and thus in each case intersects the extension line of each piston axis. This provides for a favorable force transmission arrangement.

In a further refinement of the invention, the driver axis forms approximately a right angle with the axis of rotation of the machine shaft, that is to say the driver projects transversely from the machine shaft. This provides, for the pivoting disc, which is pivotable relative to the driver, a wide pivoting range in both directions of the machine shaft. Furthermore, it becomes possible for the driver to be mounted on the machine shaft in a particularly simple way.

In accordance with the invention, the driver may have a fastening portion with a non-circular fastening cross-section and the machine shaft may have a recess with a corresponding cross-section for receiving the driver, the longest extent of the non-circular fastening cross section being arranged in a plane defined by the axis of rotation of the machine shaft and by the driver axis. The fastening cross-section is defined as a section taken transversely to the driver axis in the region of the fastening portion of the driver. As a result, a higher geometrical moment of inertia and therefore an increased stability are provided for the driver in the direction of movement of the pistons. The fastening cross-section is preferably in the form of an oval, an ellipse or a flattened circle.

In a refinement of the invention, the driver is held in the machine shaft by means of a press and/or transition fit. In this case, preferably, reduced compression is provided in the direction of the shortest extent of the fastening cross-section and increased compression is provided in the direction of the longest extent of the fasting cross-section.

In a particular embodiment of the invention, the driver has a neck portion with a non-circular neck cross-section, the longest extent of the non-circular neck cross-section being approximately in the direction of a geometrical center-plane of movement of the pivoting disc. The pivoting disc can assume, with respect to the driver, a first and a second reversal position (end position) and otherwise moves back and forth between the two end positions. The mid-position of the pivoting disc between the two end positions is defined by the so-called geometrical center-plane. The neck portion of the driver must allow space for the pivoting disc to pivot relative to the driver. At the same time, the driver should have as high a geometrical moment of inertia as possible, which can be achieved by providing a cross section, which is as large as possible. Both requirements are advantageously satisfied by a neck portion having an at least partially non-circular neck cross-section. The driver neck can thus be adapted more closely to the end positions of the pivoting disc.

In a further refinement of the invention, a preferably radially oriented receptacle, which the driver engages in a pivotable movable manner, is provided in the pivoting disc; furthermore the dimensions of the neck cross-section are adapted to the space allowed in each case by the receptacle in the end positions of the pivoting disc. The configuration of the driver neck is directly matched to the shape of the receptacle of the pivoting disc, one half of a non-circular neck cross-section being adapted to the position of the receptacle in the first end position of the pivoting disc and the other half of the non-circular neck cross-section being adapted to the position of the receptacle in the second end position of the pivoting disc.

In still a further refinement of the invention, the driver is produced integrally with the machine shaft. This results in reduced stress on the machine shaft and a low-stress and low-deformation transition between driver and machine shaft.

Further features and feature combinations will become apparent from the following description on the basis of the accompanying drawings. Actual exemplary embodiments of the invention are illustrated in a simplified form in the drawings and are explained in more detail in the following description:

DETAILED DESCRIPTION OF PREFERRED EMBODIMENTS

Figure 1:
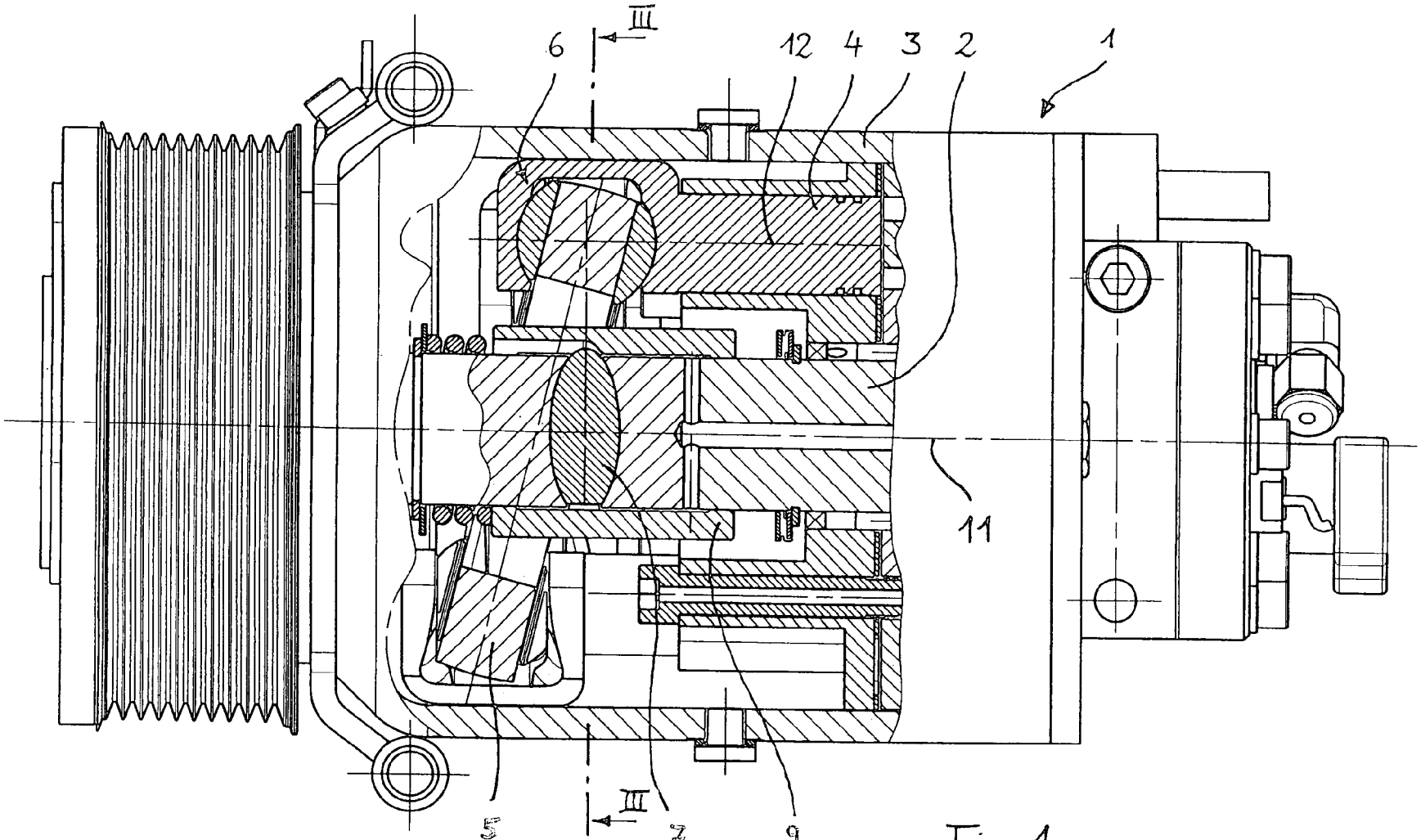
FIG. 1 shows a longitudinal section through a reciprocating-piston machine according to the invention.
Figure 2:
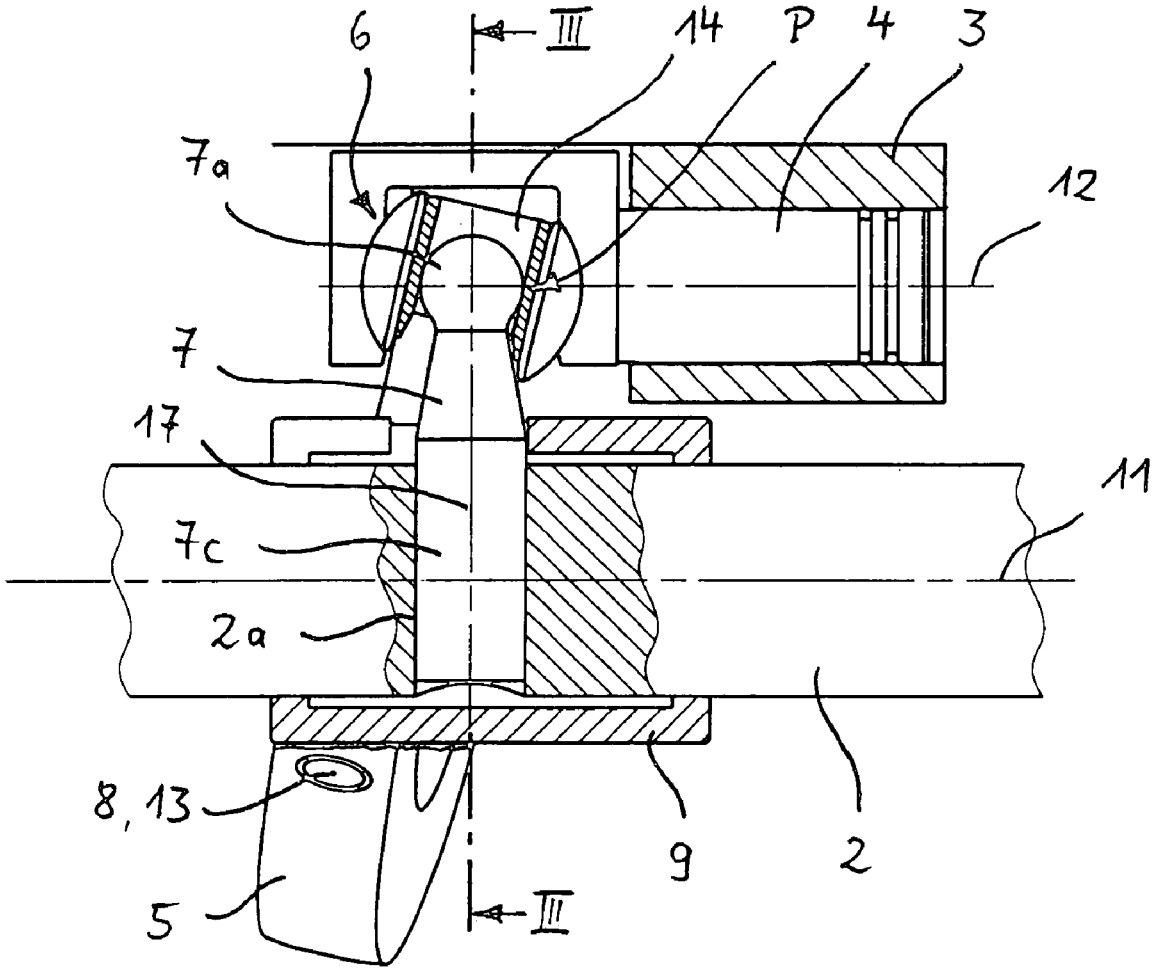
FIG. 2 shows the basic features of the reciprocating-piston machine for an explanation of the functioning of the reciprocating-piston machine according to FIG. 1.

FIG. 1 shows, in a longitudinal sectional view, a reciprocating-piston machine 1 in the form of a refrigerant compressor for a motor vehicle air-conditioning system. The reciprocating-piston machine 1 has a plurality of pistons 4 arranged in a machine housing 3. All the piston axes 12 are arranged at a fixed distance from the axis of rotation 11, that is to say geometrically on a cylinder envelope surrounding the machine shaft 2. The pistons are guided in cylindrical bushes, all the piston axes 12 being oriented parallel to the axis of rotation 11 of the machine shaft 2. The rotational movement of the machine shaft is converted into a translational movement of the pistons 4 via a force transmission arrangement explained in more detail below. FIG. 2 illustrates a simplified basic arrangement for the transmission of forces between the machine shaft 2 and pistons 4.

A sliding body in the form of a sliding sleeve 9 is slideably supported on the machine shaft 2. An annular pivoting disc 5 is mounted on the sliding sleeve 9, the pivoting disc 5 being displaceable, together with the sliding sleeve 9, parallel to the direction of the axis of rotation 11. Attached to the sliding sleeve 9 are two short pins 13 which define a hinge axis 8 which is oriented transversely to the axis of rotation 11 of the machine shaft 2 and about which the pivoting disc 5 is pivotably supported on the sliding sleeve 9.

A driver 7 is fixed in a recess 2*a* of the machine shaft 2, preferably by a press or transition fit between the fastening portion 7*c* of the driver and the recess 2*a*. In a modified exemplary embodiment, the machine shaft 2 and the driver 7 are produced integrally as a one piece component. Since the bending stress on the driver 7 extend into the associated recess in the shaft 2, so that, in the case of a press fit between driver and shaft, micro-displacements occur in the press-fit joint, the bending strength of the driver 7 can be increased and therefore bending reduced if driver and shaft consist of one piece. Low-stress and low-deformation transitions can then also be provided.

Figure 3:
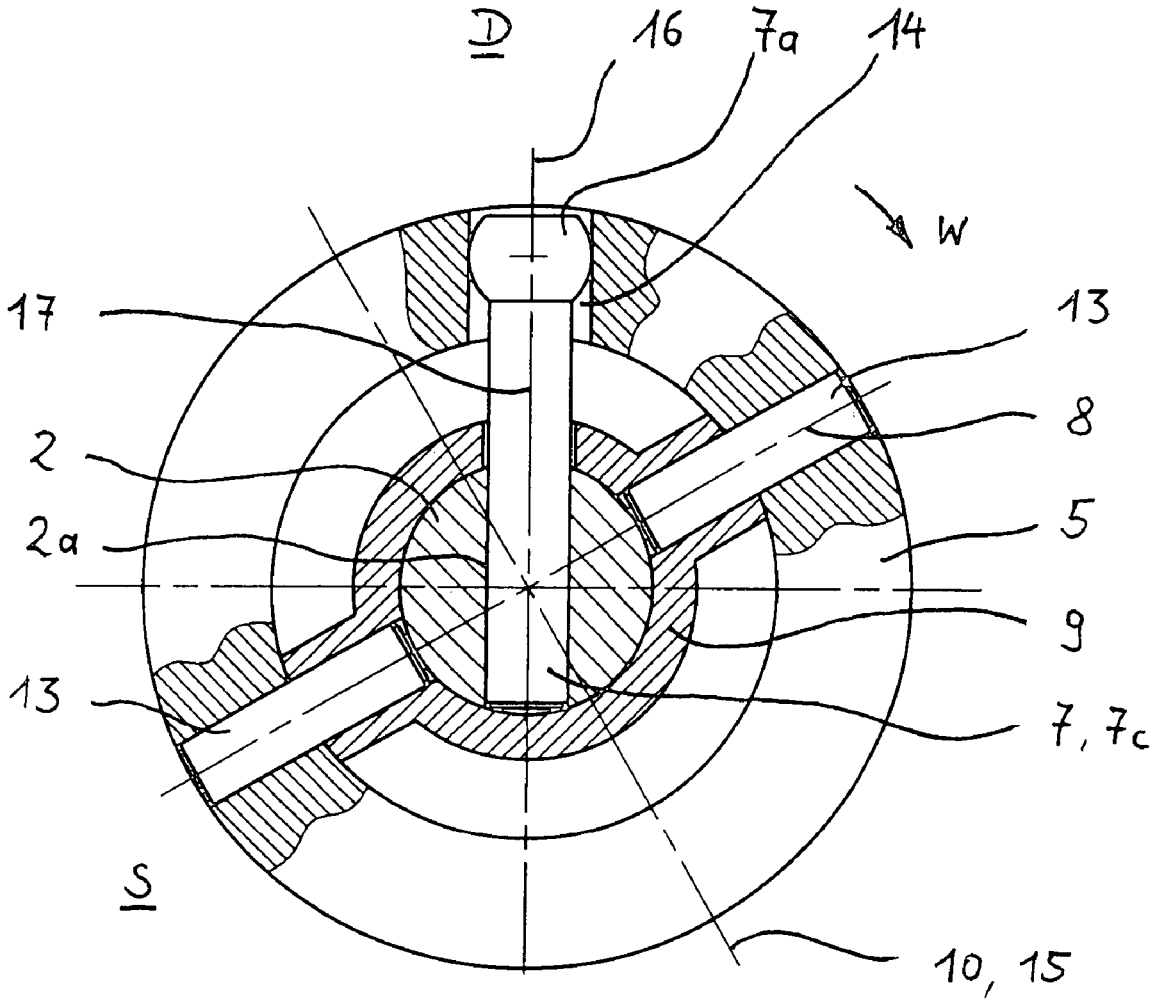
FIG. 3 shows a section through the machine shaft of the reciprocating-piston machine along the line III—III of FIG. 1.

The driver 7 projects approximately at right angles from the machine shaft and extends, with a spherical articulation portion 7*a*, into a radially open receptacle 14 of the pivoting disc (cf. FIGS. 2 and 3). Since the driver 7 is fixed to the machine shaft 2, the displacement of the sliding sleeve 9 results in pivoting of the pivoting disc about the hinge axis 8. When the reciprocating-piston machine is in operation, the rotation of the machine shaft 2 is transmitted to the pivoting disc via the driver 7 (rotational movement in the direction of the arrow w).

A main center-plane 10 extending through the axis of rotation 11 of the shaft 2 and perpendicularly to the hinge axis 8 separates a suction side S of the reciprocating-piston machine from a pressure side D (cf. FIG. 3). The main center-plane 10 rotates with the machine shaft.

In the region of each piston 4, the pivoting disc 5 engaged at opposite sides thereof by a joint arrangement 6 which slides over the pivoting disc 5 when the latter rotates as indicated by the arrow w. When the pivoting disc 5 is inclined relative to the machine shaft 2 (as illustrated in FIGS. 1 to 3), the pivoting disc 5, during its rotational movement, causes the pistons located on the pressure side D to execute a compression movement and the pistons located on the suction side S to execute a suction movement.

Further particulars as to the design and operation of the reciprocating-piston machine 2 may be gathered from U.S. Pat. No. 6,164,252 to which express reference is made hereby.

The piston forces acting on the pivoting disc are higher on the pressure side D than on the suction side. This results in a torque about an axis 15 (FIG. 3), which extends transversely to the hinge axis 8 through the main center-plane 10. The torque is transmitted via the pins 13 to the sliding sleeve 9 and from the latter further to the machine shaft 2. Since the sliding sleeve thus attempts to tilt about the axis 15 in relation to the machine shaft, contact forces occur between the sliding sleeve 9 and the shaft 2 and counteract the tilting. The contact forces, on account of the friction generated by them, impede the movability of the sliding sleeve 9 and therefore the control of the compressor stroke. These contact forces are particularly low when the center of the articulation portion 7*a* supporting the pivoting disc 5 is arranged outside the main center-plane 10 on the pressure side D of the reciprocating-piston machine. The articulation portion 7*a* is then located nearer to the resultant of the piston forces, so that lower torques and consequently the contact forces between sliding sleeve and machine shaft are lower as they are transferred to a larger extent to be shaft 2 directly by the driver 7.

Preferably, the center of the articulation portion 7*a* is arranged geometrically approximately on the cylinder envelope which contains the piston axes 12. In this case, the receptacle 14, which surrounds the articulation portion 7*a*, preferably has a major axis 16, which forms an angle of between 20° and 30° with the main center-plane 10. The driver axis 17 then preferably also forms the corresponding angle with the main center-plane 8.

Moreover, the contact point P between the articulation portion 7*a* and the pivoting disc 5 is preferably arranged approximately on the cylinder envelope, which contains the piston axes 12.

If appropriate, the contact point P may be located between the articulation portion 7*a* and the pivoting disc 5 approximately on the cylinder envelope which contains the piston axes 12, and the center of the articulation portion 7*a* may be located outside the cylinder envelope.

Figure 4:
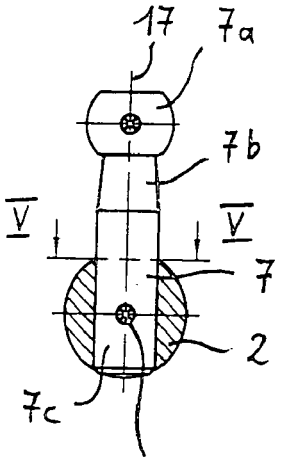
FIG. 4 shows a driver inserted into the machine shaft.
Figure 5:
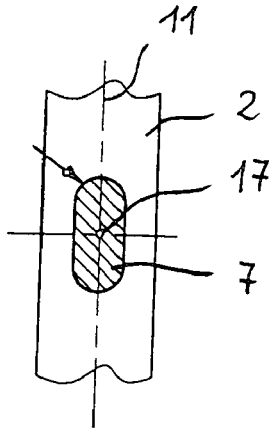
FIG. 5 shows a cross-section through the driver according to FIG. 4 along line V—V.
Figure 6:
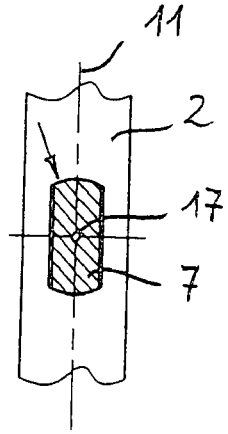
FIG. 6 shows a modified cross-section corresponding to the cross-section according to FIG. 5.

The forces acting essentially in the direction of the piston axes 12 on the articulation portion 7*a* result, in particular on the pressure side D of the reciprocating-piston machine, in a pronounced load on the driver 7 and therefore cause elastic bending of the latter. As a result, the articulation portion 7*a* is deflected or displaced out of its non-loaded position of rest. The displacement of the articulation portion 7*a* causes an enlargement of the clearance volume in the cylinders. The bending plane is, in this context, a plane which is defined by the driver axis 17 and the axis of rotation 11 of the machine shaft. In order to avoid a harmful increase of the clearance volume, the fastening portion 7*c* may be configured with a non-circular fastening cross-section transversely to the driver axis 17. The fastening cross-section corresponds to the section along the line V—V in FIG. 4 and is illustrated separately in FIG. 5. As is evident from FIG. 5, the longest extent of the non-circular fastening cross section extends along a line which lies in a plane defined by the driver axis 17 and the axis of rotation 11. As regards the situation which is illustrated in FIGS. 4 and 5 and where the driver 7 projects at right angles from the machine shaft 2, the longest extent of the non-circular fastening cross section is oriented in the direction of the axis of rotation 11 of the shaft 2. In the present instance, the non-circular fastening cross-section is in the form of an oval (FIG. 5). In modified exemplary embodiments, the non-circular fastening portion is configured, for example, as a flattened circle (cf. FIG. 6), as an ellipse or as a P2 profile. In any event, the machine shaft 2 has, for receiving the driver, a recess 2*a* with a corresponding cross-section. The recess may be configured as a blind hole or as a passage extending through the machine shaft 2. In a modified exemplary embodiment, the machine shaft 2 and driver 7 are connected to one another in a materially integral manner.

In a further exemplary embodiment, the driver 7 is held in the machine shaft 2 in the region of the fastening portion 7*c* by means of a press fit, which has reduced surface pressure transversely to the orientation of the longest extent of the non-circular fastening cross-section and increased surface pressure in the direction of the longest extent of the non-circular fastening cross section.

Figure 7:
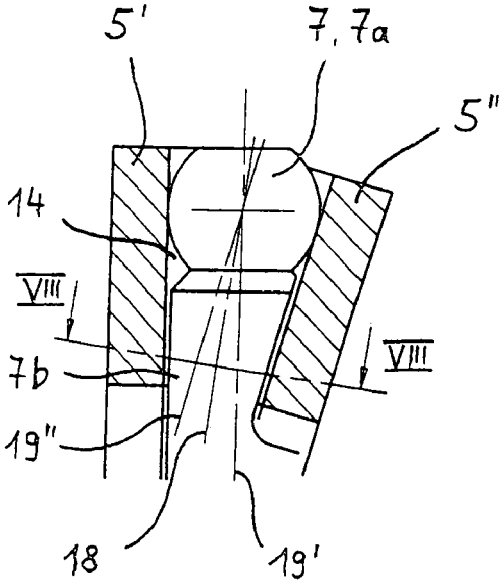
FIG. 7 shows, as a detail, an illustration of a driver head, together with a neck portion, in an installation situation, with a pivoting disc (illustrated in two extreme positions)
Figure 8:
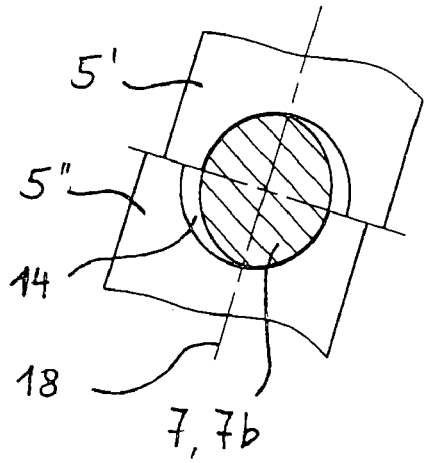
FIG. 8 shows a cross-section through the neck portion of the driver according to FIG. 7 along line VIII—VIII.

As already illustrated (FIGS. 2, 3) the driver 7 extends into a preferably radial receptacle 14 of the pivoting disc 5. When the pivoting disc pivots between its two reversal or end positions 5' and 5" (cf. FIGS. 7 and 8), it assumes different orientations relative to the driver 7, that is to say, with respect to the articulation portion 7*a*, the pivoting disc 5 oscillates about a so-called geometrical center-plane 18 which extends through the hinge axis 8. In the reversal position 5', the pivoting disc 5 is oriented exactly transversely to the machine shaft 2, and, with the driver 7 projecting transversely, the pivoting disc 5 and the driver are oriented in parallel. In the end position 5", the pivoting disc assumes a maximum angle with respect to the driver 7. At the same time, the receptacle 14 of the pivoting disc 5 is oriented in each case differently in relation to the driver 7 and therefore provides for space in a different orientation. The cross-section of a driver neck 7*b* is adapted to the space provided in each case by the receptacle 14 in the end positions 5' and 5", thus resulting in a cross-section which is non-circular, in particular is partially lemon-shaped. The longest extent of the non-circular cross-section of the driver neck 7*b* extends at least approximately in the geometrical mid-plane 18.

The surface of the driver 7 is preferably composed, at the neck portion 7*b*, of two cylinder surfaces, which are each incomplete and the diameters of which are equal and smaller, by the amount of some play as the diameter of the cylindrical receptacle 14. The geometrical center-axes 19' and 19" generally coincide with the center-axis 16 of the receptacle 14 in the respective end position and preferably intersect in the region of the articulation portion 7*a*. This results in as high a geometrical moment of inertia as possible and in as little bending of the driver neck 7*b* as possible.

Since machining about both axes 19' and 19" by lathe or by circular grinding is necessary, it is advantageous from a manufacturing point of view to define the axis 19' as the driver axis 17. This may be provided, irrespective of the orientation of the driver 7 in relation to the machine shaft 2.

In a modified exemplary embodiment, the receptacle 14 is configured so as to be widened conically inwards, that is to say towards the machine shaft 2. The surface of the driver neck 7*b* is, in this case, composed of two incomplete cone surfaces. A lemon-shaped cross section can likewise be obtained.

Figure 9:
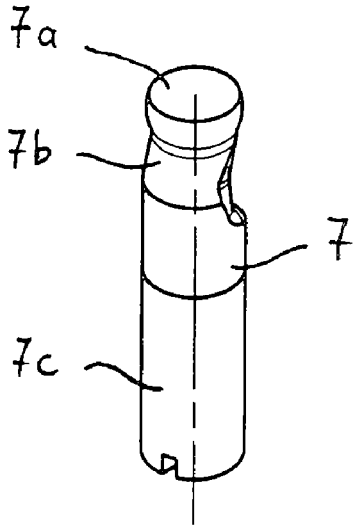
FIGS. 9 and 10 are two perspective illustrations of a driver according to the invention.
Figure 10:
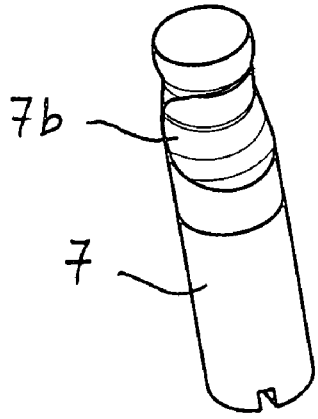

FIGS. 9 and 10 illustrate a further exemplary embodiment of a driver 7 according to the invention, in which case, inter alia, for the sake of making manufacture simpler, the driver neck 7*b* is provided with a discontinuous surface, that is to say with a surface, which has edges.

The invention claimed is:

1. A reciprocating-piston machine, in particular a refrigerant compressor (1) for a motor vehicle air-conditioning system, comprising a machine shaft (2) rotatably supported in a machine housing (3), a plurality of pistons (4) arranged circularly on a cylinder envelope extending around said machine shaft (2) in said machine housing (3), an annular pivoting disc (5) disposed around said machine shaft (2) along said envelope and being driven by said machine shaft (2), said annular pivoting disc (3) engaging the pistons (4) via a joint arrangement (6), a driver (7) mounted on said drive shaft (2) and extending therefrom to said pivoting disc and being connected thereto in an articulated manner for transmitting drive forces to said pivoting disc (5), and a sliding body (9) axially movably supported on said machine shaft (2), said pivoting disc being supported on said sliding body (9) so as to be pivotable about a hinge axis (8) oriented transversely to said machine shaft, and said driver (7) having an articulation portion (7*a*), which is located outside a main center-plane (10) which extends perpendicularly to the hinge axis (8) and through the axis of rotation (11) of the machine shaft (2).

2. A reciprocating-piston machine according to claim 1, wherein the articulation portion (7*a*) is located approximately on said cylinder envelope, which contains the piston axes (12).

3. A reciprocating-piston machine according to claim 1, wherein contact points between the articulation portion (7*a*) and the pivoting disc (5) are located approximately on said cylinder envelope which contains the piston axes (12).

4. A reciprocating-piston machine according to claim 1, wherein said driver (7) has an axis (13) which extends approximately at a right angle with respect to the axis of rotation of the machine shaft (2).

5. A reciprocating-piston machine according to claim 1, wherein said driver (7) has a fastening portion (7*c*) with a non-circular fastening cross section, and said machine shaft (2) has an opening (2*a*) which extends through the machine shaft and has a cross-section corresponding to that of said driver (7) for tightly receiving said driver (7), the longest extent of the non-circular fastening cross-section being arranged in a plane defined by the hinge axis (8) of the pivoting disc (5) and the driver axis (13).

6. A reciprocating-piston machine according to claim 5, wherein the driver (7) is held in the machine shaft (2) by means of a press fit.

7. A reciprocating-piston machine according to claim 1, wherein said driver (7) has a neck portion (7*b*) with a non-circular neck cross-section which changes, at least in sections, in the axial direction of the driver, the longest extent of the non-circular neck cross-section extending approximately in the direction of a geometrical center-plane (18) of movement of the pivoting disc (5).

8. A reciprocating-piston machine according to claim 7, wherein said pivoting disc (5) includes a radially oriented opening (14), into which the driver (7) extends in a pivotally movable manner, and the dimensions of the neck cross-section (7*b*) being adapted to the space allowed in each case by the opening (14) in the end positions (5', 5") of the pivoting disc (5).

9. A reciprocating-piston machine according to claim 1, wherein the driver (7) is an integral part of the machine shaft (2).

* * * * *